United States Patent [19]

Cadars

[11] Patent Number: 4,544,029

[45] Date of Patent: Oct. 1, 1985

[54] SEALED JOINT BETWEEN A BASIN AND A COVER PLATE

[75] Inventor: Patrick Cadars, Montigny, France

[73] Assignee: Valeo, Paris, France

[21] Appl. No.: 490,879

[22] Filed: May 2, 1983

[30] Foreign Application Priority Data

May 26, 1982 [FR] France ..... 82 09195

[51] Int. Cl.[4] ..... F28F 9/02

[52] U.S. Cl. ..... 165/149; 165/173

[58] Field of Search ..... 165/173, 175, 178, 148, 165/149

[56] References Cited

U.S. PATENT DOCUMENTS

| | | | |
|---|---|---|---|
| 3,583,478 | 6/1971 | Fieni | 165/178 |
| 4,226,280 | 10/1980 | de Ceniual et al. | 165/173 |
| 4,305,459 | 12/1981 | Nonnenmann et al. | 165/173 |

FOREIGN PATENT DOCUMENTS

| | | | |
|---|---|---|---|
| 2447583 | 4/1976 | Fed. Rep. of Germany . | |
| 2093349 | 1/1972 | France . | |
| 148393 | 9/1983 | Japan | 165/149 |

*Primary Examiner*—Sheldon J. Richter

*Attorney, Agent, or Firm*—Dennison, Meserole, Pollack & Scheiner

[57] ABSTRACT

A sealed joint between a basin (21) and a plate (43) as in the construction of a heat exchanger tank. The basin has a rim with an outwardly directed flange (23), and the plate has a rim including a U-shaped channel (42) to receive the flange together with a gasket (65). The gasket comprises at least a fillet which is suitable for being elastically deformed by being compressed between the flange and the channel to fill the space therebetween. The portion (100) of the fillet which faces the flanges is narrower than the portion (100') of the fillet which faces the channel by virtue of at least one setback (104) in the fillet between said portions thereof.

14 Claims, 9 Drawing Figures

SEALED JOINT BETWEEN A BASIN AND A COVER PLATE

The present invention relates to a sealed joint between a basin and a cover plate mounted on the rim of the basin to form a closed chamber, eg. between a tank-forming basin and a perforated plate in a heat exchanger such as the radiator for cooling water in an internal combustion engine, or for conditioning the air in the cabin of a motor vehicle.

BACKGROUND OF THE INVENTION

In such heat exchangers, the perforated plate receives a plurality of tubes forming a bundle of parallel tubes through which a first fluid (usually water) passes to exchange heat with a second fluid (usually air) which is in contact with fins on the outsides of the tubes. Each tube has at least one open end which is received in the perforated plate. The perforated plate and the basin together constitute a collector chamber relative to the remainder of the water circuit.

Such heat exchangers are constructed in very large numbers.

The present invention applies to such joints using a deformable gasket made of rubber or like material and comprising at least a fillet or rim suitable for interposing between the interfitting rims of a basin and a plate. The invention is particularly, but not exclusively, applicable to gaskets for use in heat exchangers required by the automobile industry, and may be used to seal a perforated plate and a basin, or to seal a partition plate inside a basin to divide the basin into two chambers.

Very many shapes have been proposed for such gaskets, but there still remain difficulties due to the facts that efforts are continually being made to lighten the components of heat exchangers, and in particular the basin, and that motor vehicle manufacturers are continuously tightening their specifications, eg. by requiring higher internal pressures (both static and dynamic) for the fluid flowing along the tubes, or by requiring longer service life.

Preferred embodiments of the present invention reduce such difficulties while at the same time making important contributions to facilitating manufacture of heat exchangers, to reducing their cost, and to making them safer in operation.

In one aspect, the invention applies to a sealed joint using a gasket having a rim which, before being compressed, is relatively large in the direction of compression.

SUMMARY OF THE INVENTION

The present invention provides a sealed joint between a basin and a plate, such as may be used in the construction of a heat exchanger tank, said basin having a rim with aun outwardly directed flange, and said plate having a rim including a U-shaped channel to receive said flange together with a gasket, said gasket comprising at least a fillet suitable for being elastically deformed by being compressed between said flange and said channel to fill the space therebetween, the improvement wherein the portion of the fillet facing the flange is narrower than the portion of the fillet facing the channel by virtue of at least one set-back in the fillet between said portions thereof.

The set-back makes it possible to compress the fillet to a very great extent, improves the flow of the material which constitutes the gasket, and ensures that it is compressed more smoothly.

The fact that the fillet is greatly compressed ensures that sealing is durable inspite of the inevitable deformations to which the components will be subjected during a long working life.

It also reduces the number of rejects during manufacture, by accommodating more of the irregularities presented by thinwalled housings or basins, whether due to warping or to widely dispersed dimensions.

The shape of the gasket rim or fillet, its movement in the channel, and its compression by forces pressing it directly on the bottom of the channel all help to ensure that the fillet does not move inopportunely during its compression.

The invention is particularly applicable to sealed joints in which the flexible and deformable gasket is made by molding rubber or like material, in which case the method of manufacture ensures that said set-back is formed by applying a projecting portion of one mold half into the other mold half in such a manner as to ensure theat any flash is restricted to locations where it is not inconvenient.

BRIEF DESCRIPTION OF THE DRAWINGS

Embodiments of the invention are described by way of example with reference to the accompanying drawings, in which.

MORE DETAILED DESCRIPTION

Figure 2:
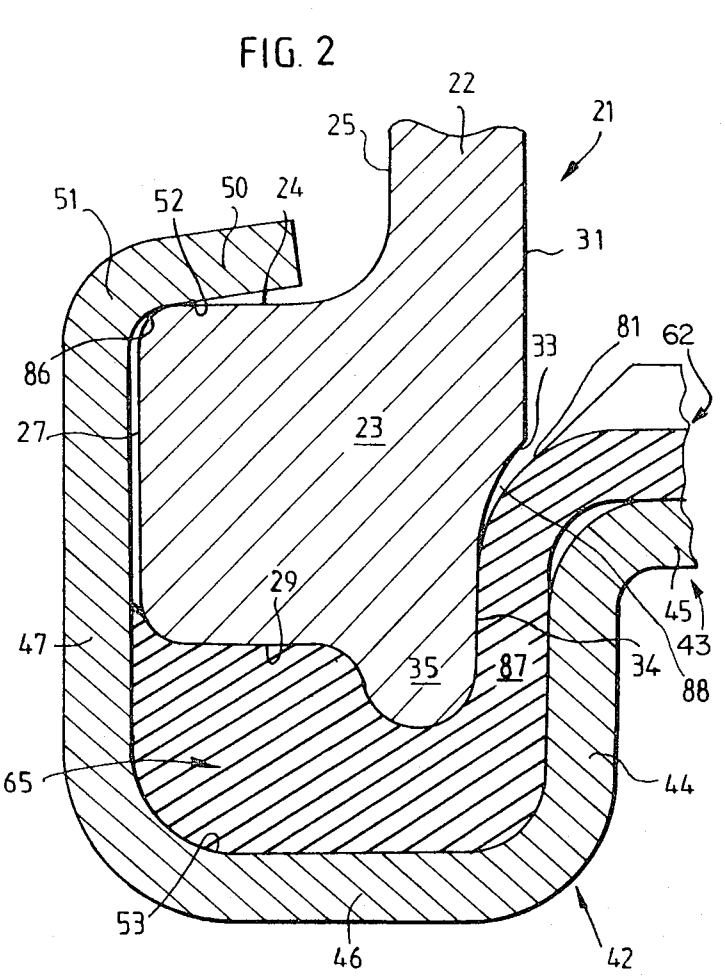
FIG. 2 is a similar view to FIG. 1, but after the fillet has been compressed.
Figure 1:
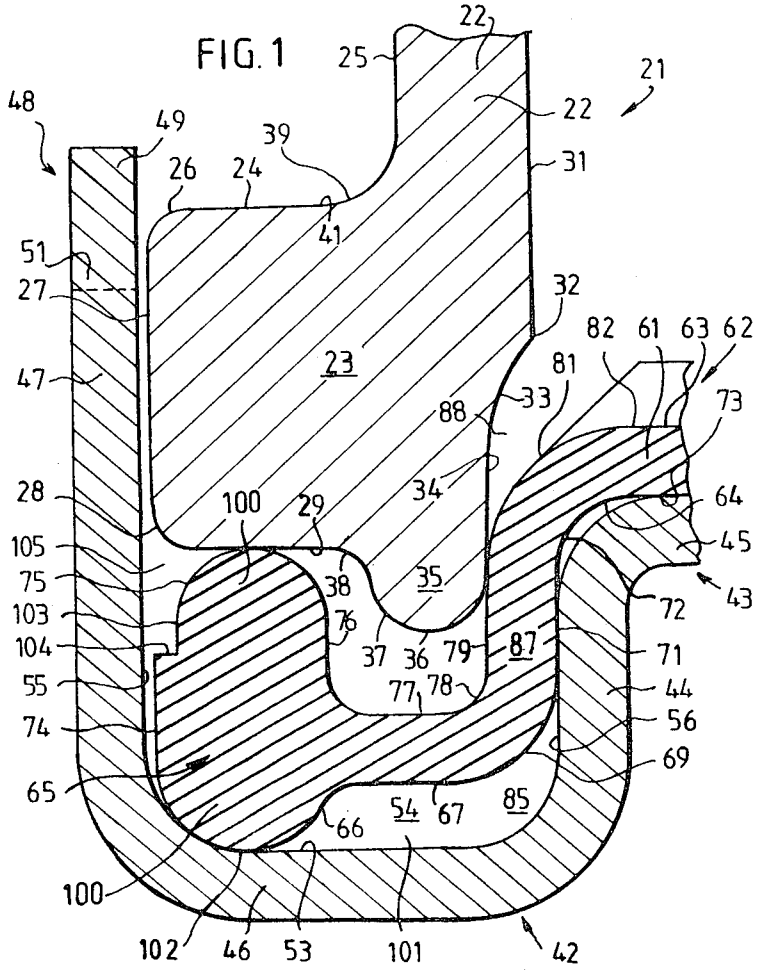
FIG. 1 is a cross section through a gasket fillet about to constitute a seal in a joint in accordance with the invention before the rim is compressed.

With references to FIGS. 1 and 2, a heat exchanger has a box or basin 21 which is advantageously made of thermoplastic material. The basin 21 is generally rectangular in shape having side walls 22 which have a rim in the form of an outwardly directed flange 23 of generally rectangular cross section. The flange 23 has a first face 24 which is perpendicular to the outside face 25 of the basin wall 22, and which is connected thereto by a curved surface 39. The flange 23 further has a second face 27 which is parallel to the outside face 25 of the basin wall 22 and which is connected to its first face 24 by a curved portion 26, and a third face 29 which is parallel to the first face 24 and which is connected to the second face 27 by a curved portion 28. The inside face 31 of the basin wall 22 extends in a substantially planar manner up to an end line 32 which is level with the middle of the second face 27 of the flange 23, and thereafter follows a curved surface 33 leading to a plane surface 34 which is parallel to the face 31 and which terminates in a lip 35 having a rounded tip 36 before following a pair of curves 37 and 38 to meet the flange's third plane surface 29. The curved surface 38 connecting the curved surface 37 to the third plane surface 29 is substantially level with the line 41 where the curved surface 39 joining the plane surfaces 24 and 25 meets the flange's first plane surface 24.

The basin 21 is intended to be connected by means of its flange 23 to the rim 42 of a perforated plate 43. The rim 43 is shaped like a U-shaped channel 54 having an inside wall 44 projecting at right angles from the main body 45 of the perforatd plate, a flat bottom 46, and an outside wall 47 parallel to the inside wall 44 and having a crenellated edge 48 to provide tabs 49 which are folded in the finished heat exchanger along a root line 51 to grip the first plane surface 24 of the basin's flange 23.

The total height of the basin's rim, ie. the distance between the rounded tip 36 and the first plane surface 24 is less than the height of the outside wall 47 from the bottom 46 up to the root line 41 where the tabs are folded over (see FIG. 2). In other words, the distance between the inside face 53 of the bottom 46 and the inside face 52 of said tabs 49 when folded over exceeds the total height of the basin's rim by an amount which is explained in greater detail below. The width of the bottom of the flange (when in the orientation shown in the drawings), ie. the distance between the second face 27 and the inside face 34, is less than the inside width of the channel 54, ie. less than the distance between the inside face 55 of the outside channel wall 47 and the inside face 56 of the inside channel wall 44.

This difference in width is substantially equal to, but slightly less than, the thickness of a web 61 of a flexible and deformable gasket 62 made of rubber or like material, and serving to seal the join between the basin 21 and the plate 43.

Th gasket web 61 has parallel upper and lower faces 63 and 64 and has a peripheral rim, fillet or thickening 65 which is taller than it is wide when in the uncompressed condition as shown in FIG. 1. The bottom surface 66 of the fillet is generally semi-cylindrical in shape and is intended to rest on the bottom 46 of the channel 54. It is connected by plane surface 67 lying substantially in the same plane as the axis of the half cylinder 66, via a first curve 69, a second surface 71 at right angles to the surface 67 and a second curved surface 72 to the lower face 63 of the web 61, where it is intended to lie on the main body 45 of the plate 43. In the uncompressed condition, the fillet 65 leaves an empty space between itself and the edge of the plate.

The outside of the semicylindrical surface 66 is extended by a plane surface 74 which runs parallel to the outside wall 47 of the channel 54. The top of the plane face 74 is extended by a second semicylindrical surface 75 which is intended to cooperate with the third plane surface 29 of the flange 23. Both of the semicylindrical surfaces are convex. The inside edge of the upper semicylindrical surface 75 runs on into a plane surface 76 which faces and is parallel to the inside wall 44 of the channel 54 as well as being parallel to the outside plane face 74. The face 76 curves to meet a plane surface 77 which then follows a curve 78 to meet a plane surface 79, followed by another curve 81 to run into the upper surface 63 of the gasket web. The surfaces 77, 78, 79, 81 and 63 are respectively parallel to the surfaces 67, 69, 71, 72 and 64, running along either side of a joggle-shaped portion of gasket web of substantially uniform thickness.

FIG. 1 shows a gasket before being compressed between the basin and the plate. Once compressed, the assembly is held together by folding down the tabs 49 about their root lines 51 so that the parts are brought to the position shown in FIG. 2. During this operation, the basin 21 is brought closer to the perforated plate 43, and in particular, the flange 23 of said basin is pressed into the channel 54 in the rim 42 of the perforated plate.

During this movement, the third plane face 29 of the flange 23 compresses the fillet 65 of the gasket, via its semicylindrical surface 75. The flexible gasket material is thus caused to flow into the empty space left between the gasket and the portions of the channel 54 where the fillet is not being pressed. In particular it flows into the space 85 between the surfaces 66, 67, and 69 of the gasket when not compressed and the facing inside surfaces 53 and 56 of the perforated plate's rim 43.

While a tab such as the tab 49 is being folded over, the inside face 86 of its root line 51 comes initially into contact with the curved surface 26 of the flange 23 in such a manner that the portion 87 of gasket web which lies between the faces 71 and 79 is slightly compressed by the surface 34 and the lip 35 pressing the face 71 of the gasket web against the inside face 56 of the chanel 54.

The force exerted by the tab 49 has a vertical component which is substantially completely conveyed to the perforated plate 43 by the apex 102 of the bottom semicylindrical surface 66 of the fillet. In accordance with the invention, there is a set-back in the surface connecting the outside surface 74 of the fillet 65 to the inside surface 76 thereof, suitable for enabling the fillet material to flow when the fillet is compressed by the flange's third surface 29.

In the FIG. 1 embodiment of the invention, the set-back comprises a joggle along a ledge 104 between the outside surface 74 and the substantially parallel portion 103 of the upper semicylinder 75. In other words the semicylindrical surface 75 is set back from the outside face 74, leaving more space between the fillet 65 and the outside wall 47 of the channel 54 level with the semicylindrical surface 75 than level with the plane surface 74. There results a larger gap 105 than there would have been had the semicylindrical surface 75 been a direct continuation of the plane surface 74. In the FIG. 1 embodiment, the ledge 104 extends substantially parallel to the bottom of the channel 54.

FIG. 2 shows the parts in sealed assembly. The rubber of the fillet 65 flows under the effect of the pressure exerted by the third face 29 of the flange 23 on the facing surface of said fillet. The space between said third face 29 and the inside walls of the channel 54 is filled with rubber or like material, under compression. The thickness of the gasket material is chosen to ensure that if tabs 49 open up slightly, as sometimes happens, then the seal remains pressure tight with the gasket's elasticity being sufficient to retain operating pressures.

When the gasket is being compressed and the tabs are being bent down, the force applied to the flange 23 is substantially perpendicular to the bottom 46 of the channel 54, so that the fillet 65 has substantially no tendency to move transversally, even if its bottom surface 66 has been soiled with grease or other lubricant. By providing a sufficiently large space 105, the set-back which gives rise to the ledge 104 ensures that the gasket material flows under advantageous conditions.

In the embodiment shown, as in all other embodiments of the invention, the portion 100 of the fillet 65 facing the flange is narrower than the portion 100' facing the bottom of the channel 54, because of the set-back which exists between said portions. In practice said set-back faces the flange. Likewise in all embodiments, the fillet is relatively thick in the direction in which it is to be compressed.

In operation of the heat exchanger, with increasing pressure of the water inside the collector chamber which is delimited by the basin 21 and the perforated plate, the lip 35 and the face 34 exert increasing pressure on the gasket web portion 87, thereby avoiding any need for special measures to prevent liquid penetrating the gap 88 between the gasket web 61 and the curved face 33 of the flange 23, such as using particularly elastic rubber for the web portion 87.

As the pressure increases, the resulting forces tending to urge the basin 21 away from the perforated plate 43 have little effect on the folded down tabs 50, and the assembly remains pressure proof.

Overall, a seal in accordance with the invention can be used with a basin having thinner walls than is conventional, and hence a basin which is more flexible, while at the same time providing a longer-lasting seal than has previously been the practice.

Since the forces applied to the flange 23 by the gasket 62 are applied close to the curved root line 51 of the tabs 49, the unbending forces applied to the tabs are minimised.

A sealed assembly in accordance with the invention also has the advantage of minimising the effects of widely dispersed dimensional tolerances as are inevitable with mass production. Further, it facilitates positioning the parts to be assembled since the gasket is compressed smothly or progressively.

Figure 3:
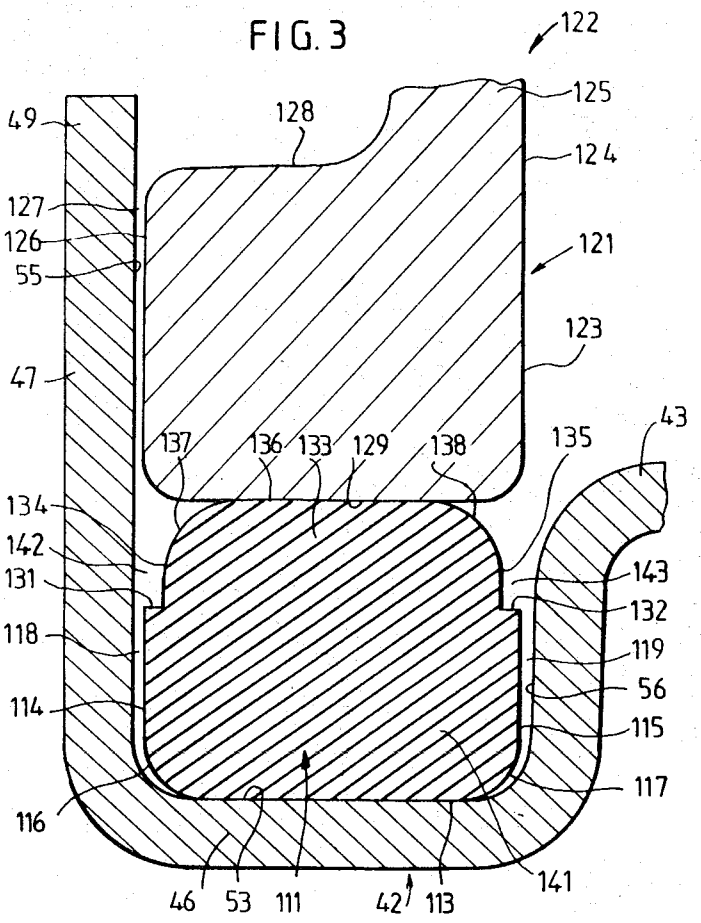
FIG. 3 is a similar view to FIG. 1, but showing a second fillet before compression.

FIG. 3 shows a variant in which the gasket 111 does not have a web, but comprises only a fillet which is wider than it is high, and which is of substantially rectangular cross section, having a bottom 113 pressed against the inside bottom surface 53 of the U-shaped channel rim 42 of the perforated plate 43. The inside and outside faces 114 and 115 of the gasket 111 are substantially plane and meet the bottom face 113 via rounded portions 116 and 117. (All references to directions being "up" and "down", etc. are relative to the orientation shown in the drawings.) The gasket 111 is slightly narrower, before it is compressed, than the channel in which it is placed, thereby leaving two narrow gaps 118 and 119 between its side faces and the inside faces 55 and 56 of the sides of the channel.

In this embodiment, the rim of the basin 122 is constituted by a substantially rectangular flange 121 having a an inside face 123 extending the inside face 124 of the basin wall 125, a top face 128, a bottom face 129, and an outside face 126 which is parallel to the inside face 123. The outside face 126 leaves a narrow gap 127 between itself and the inside face 55 of the outside wall 47 of the channel, said gap remaining even when the parts are assembled by the inside faces 52 of the folded down tabs 50 pressing against the top face 128 of the flange 121 (see FIG. 4).

The top portion 133 of the gasket facing the flange 121 differs from the bottom portion 141 of the gasket facing the bottom of the channel, in that the top portion is narrower than the bottom portion, having a set-back in each of its sides comprising ledges 131 and 132 leading back from the side faces 114 and 115 respectively to plane portions 134 and 135 which then curve over to run into opposite sides of a plane top portion 136. When the gasket is uncompressed, the ledges 131 and 132 are slightly higher than the bottom surface 129 of the flange when the assembly has been compressed.

In this embodiment, there is not only a ledge 131 in the outside face of the gasket opposite to the outside wall 47 of the channel, but also a second ledge 132 on the inside face of the gasket opposite to the inside wall 44 of the channel. Both of these ledges face the flange 121.

FIG. 3 shows the parts before the basin is crimped to the perforated plate, ie. before the tabs 49 are folded down.

Figure 4:
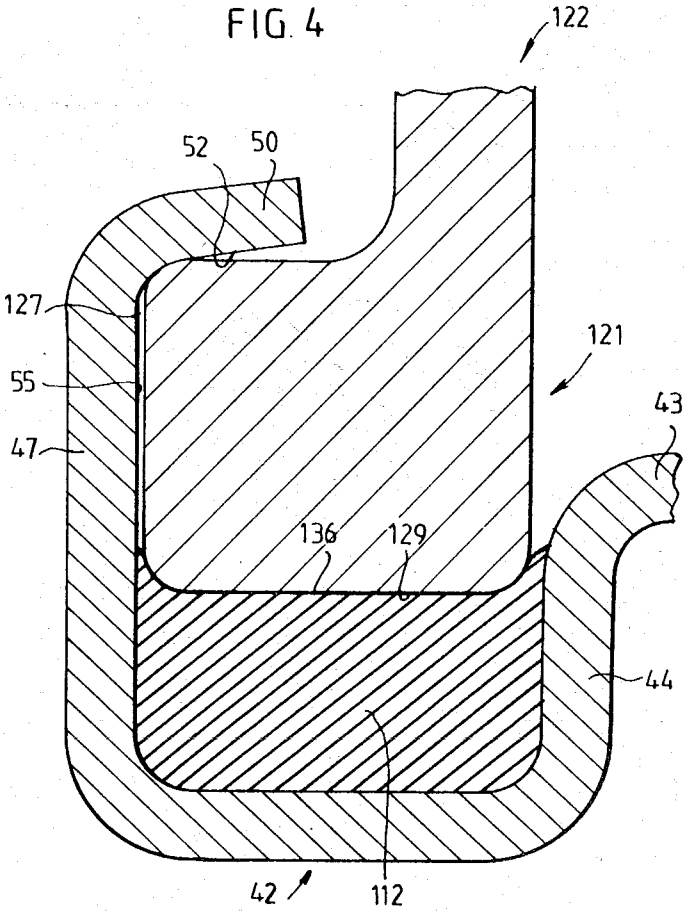
FIG. 4 is a similar view to FIG. 2 but showing the FIG. 3 fillet when compressed.

FIG. 4 shows the parts after the tabs have been crimped down. The rubber or like material of the gasket fills the empty space left between the flange 121 and the channel-shaped rim 42 of the perforated plate, including the gaps 142 and 143 left by the ledges 131 and 132 in the top portion 133 of the gasket.

The set-backs facilitate proper insertion of the basin's flange into the channel, and also ensure that the gasket is compressed progressively.

In a variant of the gasket described with reference to FIGS. 3 and 4, the gasket need only have one set-back in its top portion, eg. on the outside thereof.

Naturally, the gasket shown in FIGS. 3 and 4, or its variant mentioned above, does not play a part in sealing the tubes to the perforated plate. This sealing may be performed using some other gasket or by using a force fit between the tubes and the holes in the perforated plate.

Figure 5:
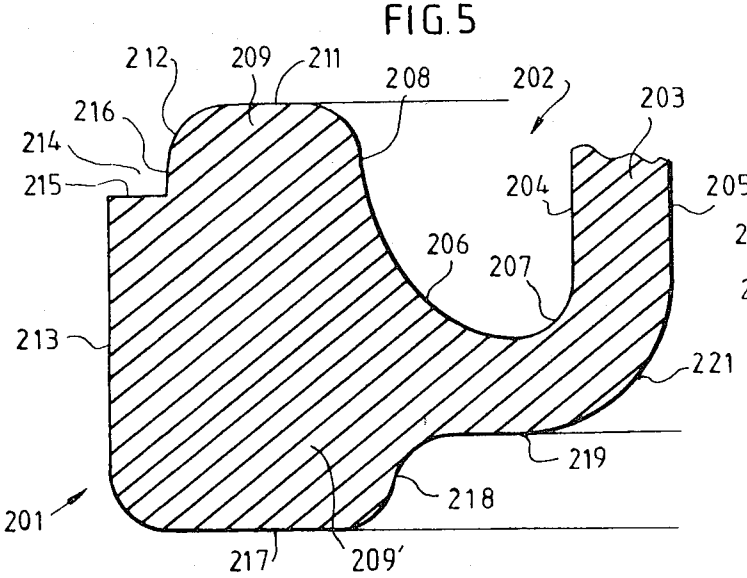
FIG. 5 is a cross section through a third fillet.

Reference is now made to FIG. 5 which shows another gasket. This gasket 202 is taller than it is wide and is again suitable for use between a basin and a perforated plate in a heat exchanger. The gasket 202 has a peripheral fillet 201 around a web 203 of uniform thickness which extends between parallel faces 204 and 205. The fillet 201 comprises a curved portion 206 of relatively large radius of curvature which meets the surface 204 via a portion 207 of relatively small radius of curvature. The outer side of the surface 206 curves via a portion 208 to meet a broad ridge 209 having a substantially flat top surface 211. The outside of the top 211 curves down at 212 to meet an outer plane surface 213 via a plane portion 212 and an outwardly extending ledge 215, thereby leaving a gap or space 214. The surface 213 meets a bottom surface 217 perpendicular thereto via a suitably rounded edge, and the inside edge of the bottom surface 217 follows a further curve 218 to meet a small plane surface 219 parallel to the bottom surface 217. The inside edge of the small plane surface 219 then follows a curve 221 to meet the under surface 205 of the gasket web 203. As in the previously described embodiments, the top portion 209 of the fillet facing the flange on the basin, is narrower than the bottom portion 209' of the fillet where it is received in the perforated plate's peripheral channel.

The use of a plane bottom surface 217 avoids any risk of the fillet sliding on the bottom of the perforated plate's channel when pressure is applied to assemble the basin and the plate. This remains true even if grease or some other lubricant is applied to the surface of the gasket, intentionally or otherwise. This helps to ensure that during compression, the forces are applied substantially at right angles to the bottom surface 217.

The ledge 215 ensures extra space for the gasket material to flow into during compression.

Figure 6:
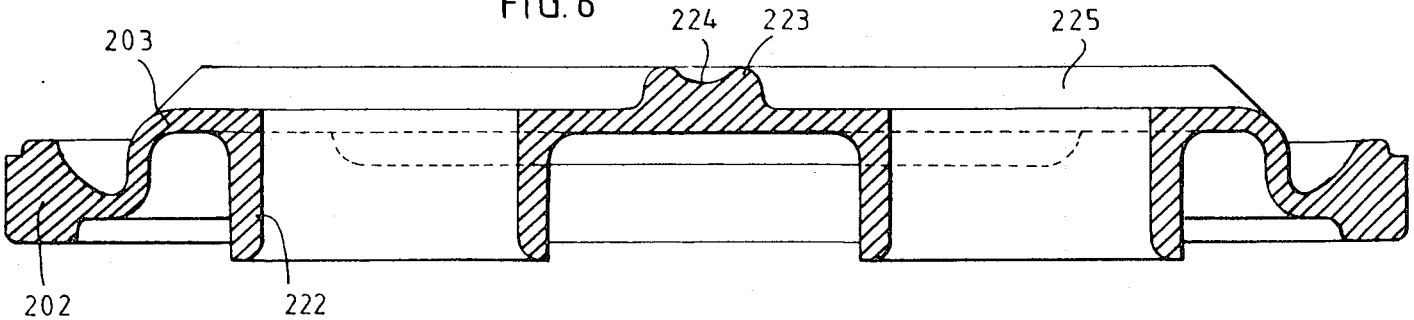
FIG. 6 is an overall section through the gasket having the fillet shown in FIG. 5.

FIG. 6 is a cross section through an entire gasket comprising a fillet 202 as described above, and a web 203 which includes short sleeve members 222 for providing sealing between the tubes of the heat exchanger and the perforated plate. A central spine 223 with a groove 224 therein is provided to cooperate with a partition extending from the basin, thereby dividing the tank into two compartments.

Figure 7:
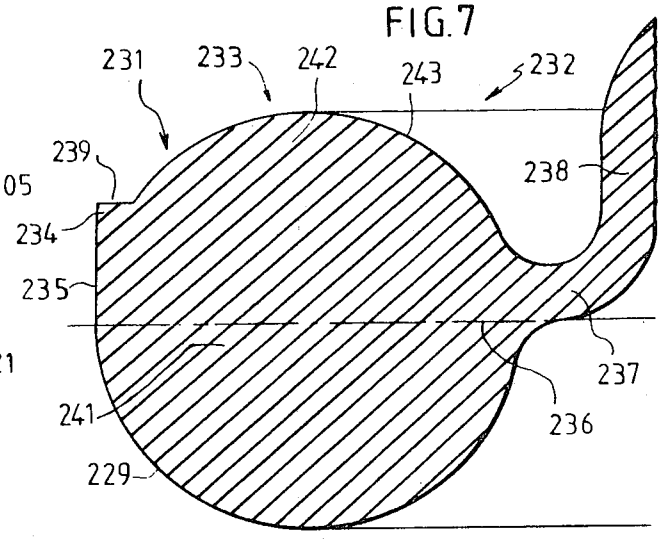
FIG. 7 is similar to FIG. 5, but shows a forth fillet.

Reference is now made to FIG. 7, which shows a variant shape for the fillet. In this embodiment, the peripheral fillet 231 of a gasket 232 has a substantially cylindrical surface 233 which has a projection 234 on the upper half of its outside surface. The projection 234 comprises two plane surface portions: an outer plane surface portion 235 which is tangential to a bottom portion 229 of the cylindrical surface 233 for being received in a channel around the periphery of a perforated plate and which is at right angles to a diametral plane 236 via which the fillet runs into a joining piece 237 leading to the central web 238 of the gasket; and a ledge 239 which is at right angles to the outer plane 235. The ledge 239 again ensures that the fillet leaves a space adjacent to a top portion 242 facing the flange of the basin, by having a setback between said top portion 242 and a bottom portion 241.

To make gaskets with one or more set-backs as described above, the invention also provides a method of moulding said gaskets in which method unwanted flash on the fillet is avoided. The method consists in sealing the join plane between the two halves of a mold which are applied to each other to constitute a mold cavity. This is done by one of the halves having a projection of material which is harder than the material of the other half so that by the known technique of penetration, the projection is a perfect fit in the groove in which it is received.

Figure 8:
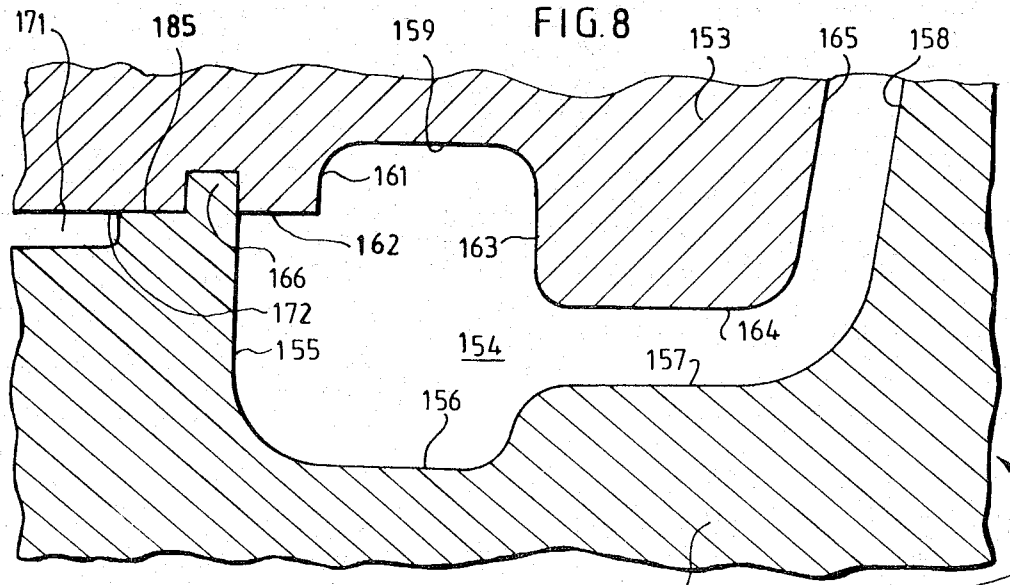
FIG. 8 is a section through a portion of a mold for making a gasket.

FIG. 8 shows a mold 151 comprising a lower mold half 152 and an upper mold half 153. The lower mold half 152 is made of harder material than the upper mold half 153. The mold halves delimit a mold cavity 154, with the lower mold half 152 having a surface 155 defining the outside surface of a gasket fillet cast therein, a bottom surface 156 corresponding to the bottom surface of the fillet, a surface 157 corresponding to the lower surface of the curved portion of the gasket web, and a surface 158 extending said surface 157.

The upper mold half 153 has a surface 159 delimiting the top of the fillet, a surface 161 corresponding to the small outer side surface, a horizontal surface 162 corresponding to the ledge, and a surface 163 corresponding to the larger inside face of the fillet.

In the embodiment shown in FIG. 8, the upper mold half 153 has a surface 164 corresponding to the top surface of the curved portion of the gasket web, and a surface 165 extending said surface 164 and parallel to the surface 158 of the lower mold half 152.

The lower mold half 152 has a surface 185 which is shaped to engage the facing surface 172 of the upper mold half 153 in such a manner that a projection 166 is received in a groove. There follows a space 171 so that the surface 185 projects therefrom.

Figure 9:
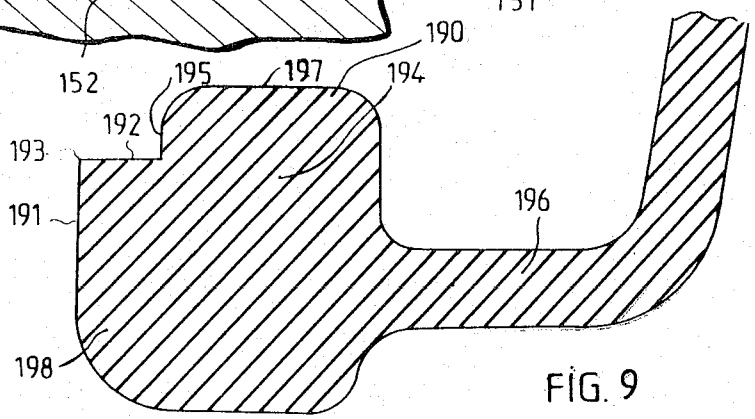
FIG. 9 is a cross section through a fillet obtained using the mold of FIG. 8.

Using such a mold ensures that any flash on a gasket of rubber or like material cast therein, is limited at worst to flash extending the face 191 (FIG. 9) along the edge 193 where it meets the step 192. The cross section of the gasket is generally rectangular except for the step around the faces 192 and 195 which serves to distiguish the upper portion 190 of the rim 194 intended to come into contact with the flange on the basin, and the broader lower portion 198 intended to be received in the channel section rim of the perforated plate. All the outside angles other than along the edge 193 are rounded, including those leading to the web 196. In particular there is no danger of flash extending the top face 197 on which the basin's flange applies pressure.

The present invention is not limited to the particular shapes which have been described, but is applicable to any other shapes falling within the definitions of the claims. In particular, in the embodiment shown in FIGS. 1 and 2 the basin and the perforated plate are described as being held together by bending over tabs 49. An alternative fixing system would be to provide segments in the outer wall 47 of the channel above oblong holes and to upset or crimp and segments onto the upper surface 24 of the flange while the basin was being pressed towards the perforated plate. Once the segments are properly in place the pressure can be released and the assembly will remain fixed together.

The flange on the basin may be provided with elastically deformable tabs suitable for snap-fitting into openings provided for the purpose in the outer wall of the channel.

The ledge need not be at right angles to the other plane surface of the fillet: it could be at some other angle thereto.

The mold described with reference to FIG. 8 can be adapted to obtaining any of the gasket shapes described with reference to FIGS. 1 to 7.

Finally, it wil be understood that using a set-back in the outside face of the fillet minimises rubber becoming encrusted between the flange and the outside wall of the channel.

What is claimed is:

1. A sealed joint between a basin and a plate, such as may be used in the construction of a heat exchanger tank, said basin having a rim with an outwardly directed flange, and said plate having a rim including a U-shaped channel to receive said flange together with a gasket, said gasket comprising at least a fillet suitable for being elastically deformed by being compressed between said flange and said channel to fill the space therebetween, the improvement wherein the portion of the fillet facing the flange is narrower than the portion of the fillet facing the channel by virtue of at least one set-back in the fillet between said portions thereof and said set-back is in the form of a ledge in the surface of the fillet, said ledge facing said basin flange.

2. A sealed joint according to claim 1, wherein said set-back is in the inner face of the fillet.

3. A sealed joint according to claim 1, wherein said set-back is in the outer face of the fillet.

4. A sealed joint according to claim 3, wherein, before the gasket is compressed, the set-back ensures that the space between the outer face of the fillet and the facing inside face of the outside wall of the channel is larger close to the flange than it is close to the bottom of the channel.

5. A sealed joint according to claim 3, wherein the portions of the fillet facing the flange and facing the bottom of the channel are cylindrical in shape, and wherein one end of the set-back meets a plane surface facing the outside wall of the channel.

6. A sealed joint according to claim 5, wherein the other end of said set-back is connected to a plane surface which is stepped back inwardly away from said plane surface facing the outside wall of the channel.

7. A sealed joint according to claim 5, wherein the cylindrical portion of the fillet facing the flange has a projection on its outer half, said projection being delimited by said plane surface and said set-back.

8. A sealed joint according to claim 7, wherein said plane surface is tangential to the cylindrical portion facing the bottom of the channel.

9. A sealed joint according to claim 3, wherein the portions of the fillet respectively facing the flange and the channel are of substantially rectangular section, and wherein one end of said set-back meets a plant surface facing the outside wall of the channel.

10. A sealed joint according to claim 9, wherein the flange of the basin is of substantially rectangular cross section.

11. A sealed joint according to claim 9, wherein the flange has a lip facing the fillet, and wherein the fillet is connected to a gasket web, said lip and the facing portion of said channel defining a space which is substantially as thick as the gasket web.

12. A sealed joint according to claim 11, wherein the inside surface of the fillet is connected to the gasket web by a curved portion of gasket.

13. A sealed joint according to claim 11, wherein the gasket rim is taller than it is wide.

14. A sealed joint according to claim 13, wherein the inside surface of the fillet is connected to the gasket web by a plane portion of gasket.

* * * * *